United States Patent [19]

Stewart et al.

[11] 4,370,972

[45] Feb. 1, 1983

[54] ATTACHMENT MEMBER FOR SECURING THE ENDS OF CABLES IN A COMPOUND BOW

[75] Inventors: William R. Stewart; Gary Simonds, both of Gainesville, Fla.

[73] Assignee: Victor United, Inc., Chicago, Ill.

[21] Appl. No.: 175,890

[22] Filed: Aug. 6, 1980

[51] Int. Cl.[3] ..... F41B 5/00

[52] U.S. Cl. ..... 124/23 R; 403/215; 403/213; 124/86

[58] Field of Search ..... 124/24 R, 23 R, 90, 124/86; 24/122.6, 135 N; 403/215, 213, 210, 209

[56] References Cited

U.S. PATENT DOCUMENTS

| | | | |
|---|---|---|---|
| 2,189,671 | 2/1940 | Mardis | 403/210 |
| 3,486,495 | 12/1969 | Allen | 124/24 R |
| 3,704,488 | 12/1972 | Higgins | 403/209 |
| 3,928,889 | 12/1975 | Wartian | 403/209 X |
| 4,202,316 | 5/1980 | Barna | 124/24 R |

*Primary Examiner*—Richard C. Pinkham
*Assistant Examiner*—William R. Browne
*Attorney, Agent, or Firm*—Emory L. Groff, Jr.

[57] ABSTRACT

Cable ends of a compound bow are adjustably and securely anchored by an attachment member pivotally mounted adjacent the bow eccentric wheels. The attachment member body is of substantially constant thickness and includes a plurality of openings therethrough parallel to the opposite planar faces of the body and angularly offset relative to one another to define a circuitous cable pathway. An end section of the cable is secured by insertion of a threaded lock device through an edge wall of the body into an enlarged transverse anchor bore allowing radial distortion of crimping of the cable end section.

11 Claims, 6 Drawing Figures

ATTACHMENT MEMBER FOR SECURING THE ENDS OF CABLES IN A COMPOUND BOW

This invention relates generally to archery bows and more particularly to an improved attachment member for securing the ends of cables in a compound bow.

The present invention is especially adapted for use with compound bows wherein the terminal portions of the eccentric or pulley cables are intended to be anchored in the area adjacent the tips of the bow limbs. Such bows may include two, four, or more wheels about which portions of the cable pass and until the present invention, one of the more common methods of securing the free ends of the cable adjacent the bow limb tips has comprised the step of passing the terminal portions of the cable about the eccentric pivot pins and thereafter attaching the distal portion of the cable to the same cable by means of an appropriate crimped fastener. Quite obviously, such an attachment leaves considerable to be desired. In some instances, the crimped fastener has been known to fail and probably more importantly, such a fastener can only be properly applied with a special tool at the time of manufacture of the bow cable and subsequently leaves no provision for manipulation or adjustment by the user. This former approach raises quite a disadvantage since it does not provide any means by which an archer may readily custom-string or adjust the cable tension of his compound bow.

As will be appreciated by those familiar with compound bows, the stringing or outfitting of such a bow with its cable and bow string is very critical in order to achieve a proper balance or synchronization of the eccentrically mounted wheels. By the present invention an improved cable end attachment member is provided which may be readily used by an archer even in the field and allows quick attachment aand subsequent adjustment of either or both cable ends with the result that an accurate, positive secure anchoring of the cable terminal ends is achieved.

The instant attachment member includes an enlarged base section attached to a narrow pivot section with the two sections forming a relatively thin body of constant thickness so that the member may be utilized by attaching it to the bow wheel pivot pin either inside or outside the spaced apart elements of the wheel attachment means or bracket at the low limb tips in the area previously accupied by a cable end crimped about the pivot pin. Additionally, the attachment member base section is provided with a pair of angularly offset, converging cable passageways which allow the insertion of either cable end therethrough to form a small acute angle between the cable portions disposed within the two passageways. Positive fixation of the inserted cable end is insured by the lateral insertion of a threaded lock device which engages the end-most section of the cable to radially deflect it into an enlarged transverse bore communicating with one of the cable passageways.

Accordingly, one of the objects of the present invention is to provide an improved archery bow cable end attachment member provided with a base section having a circuitous pathway for the cable end together with releaseable lock means engageable with a portion of the cable end passing through the attachment member base section.

Another object of the present invention is to provide an improved archery bow cable end attachment member having a circuitous pathway therein for the cable end and including a constant thickness body having adjacent pivot and base sections allowing of mounting of the member either inside or outside the bracket means serving to mount eccentric wheels on the bow limb tips.

Still another object of the present invention is to provide an improved archery bow cable end attachment including an attachment member having a minimum thickness defined by two planar faces and containing two angularly disposed cable passageways defining a small acute angle therebetween for reception of portion of a cable end.

Another object of the present invention is to provide an improved archery bow cable end attachment member having a base section provided with diverging cable passageways one of which cooperates with an enlarged transverse anchor bore communicating with a lock device such that tightening of the lock device radially deflects the cable into the anchor bore.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawing.

Figure 1:
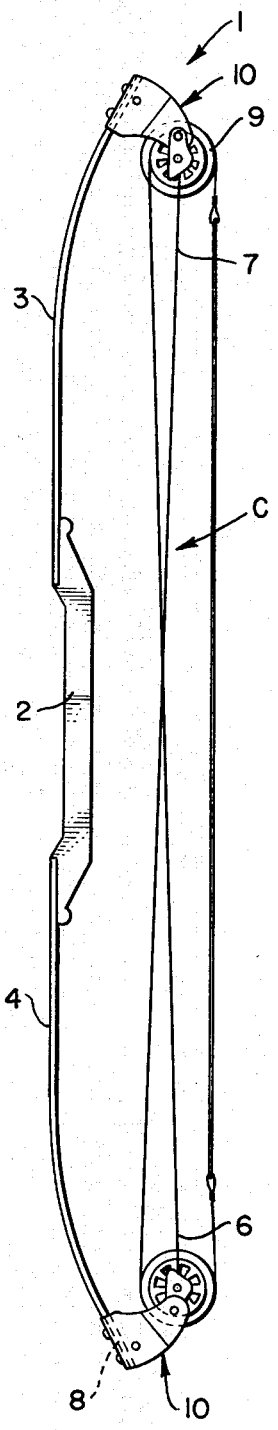
FIG. 1 is a side elevation of a typical compound bow incorporating the cable end attachement member of the present invention.

Referring now to the drawing, particularly FIG. 1, the present invention will be understood especially to relate to a compound bow, generally designated 1, having a central handle 2 and a pair of limbs 3-4 extending therefrom. It will be appreciated that the cable attachment system proposed by this invention may be practiced in combination with numerous types of archery bows and therefore the illustrated bow 1 is merely exemplary since the essence of the invention resides in the unique cable end attachment member 5 which is used to adjustably secure both the first cable end 6 and second cable end 7 with respect to the two adjacent bow limb tips 8-8.

Regardless of the number of wheels or pulleys found in any single compound bow there usually will always be at least a pair of pulleys appropriately mounted adjacent the two bow limb tips 8 such as shown in FIG. 1 of the drawing. Thus, this figure illustrates the very basic concept of a compound bow by disclosing a wheel or pulley 9 eccentrically mounted adjacent the two bow limb tips 8 by means of wheel limb attachment means such as the illustrated bracket 10. This type of bracket includes a base 11 overlying and suitably affixed to the limb tip 8 by appropriate fasteners 12. Depending from the base 11 are a pair of side arms or elements 13-13 defining a wheel receiving opening 14 therebetween.

The wheel 9 is mounted for rotation between the side elements 13-13 by means of a pivot pin or shaft 15 disposed through the eccentrically located pivot bore 16 and supported in holes within the two elements 13. Any suitable pivot pin retainer means may be utilized such as the external snap rings 17. It will be understood that although brackets 10 are shown in the drawing for the purpose of supporting the wheels, quite obviously alternative wheel limb attachment means may be utilized as is well known in the art. For example, many bows use a split limb attachment for the compound bow eccentric wheels wherein a central groove is provided through both limb tips with the wheels disposed therein and suitably supported by the same type of pivot pin appropriately supported by these spaced apart limb tip sections and spanning the groove therebetween.

The two ends 6 and 7 of the cable C are conveniently secured adjacent each wheel 9 by the use of one of the cable end attachment members 5 which will be seen to be journaled about the same wheel pivot pin 15.

The attachment member 5 comprises an enlarged, lower, cable receiving base section 18 joined to a narrower, pivot section 19 to form an integral body 20 having planar, and parallel first and second body faces 21 and 22 respectively. The body faces are joined by a peripheral transversely extending body edge 23 including a first transverse wall 24 and second transverse wall 25 connected by the bottom wall 26. The laterally narrow, upper pivot section 19 includes a transverse pivot bore 27 disposed adjacent the uppermost end 28 of the attachment member.

Figure 5:
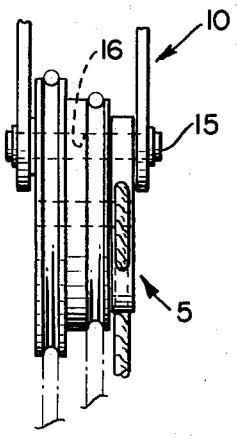
FIG. 5 is a fragmentary elevation illustrating the attachment member mounted inside the wheel mounting bracket as in the lower portion of FIG. 1.
Figure 6:
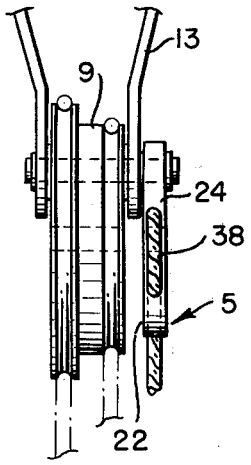
FIG. 6 is a view similar to FIG. 5 and illustrates the alternative mounting of the cable end attachment member outside the wheel bracket as in FIG. 4.

The mounting of the attachment member 5 as described up to this point will be readily understood when considering the alternative arrangements as shown particularly in FIGS. 5 and 6 of the drawings. In the embodiment of FIG. 5, the attachment member 5 is shown as it would appear when mounted inside or between the side elements 13 of a bracket 10 and wherein the second body face 22 is juxtaposed the side 29 of the wheel 9 and is similar to the installation such as shown in the lower portion of FIG. 1 where the first cable end 6 is secured thereby. In the other arrangement illustrated in FIG. 6, the cable end attachment member 5 is mounted upon the pivot shaft 15 at a point outside one of the bracket side arms 13. This view illustrates the arrangement shown in the upper portion of FIG. 1 and serves to secure the second cable end 7. In passing, it should be noted that usually both brackets of the wheel limb attachment means on any one bow will be similar and not mixed as in FIG. 1 wherein the upper bracket side arms 13 are spaced as in FIG. 6 while the lower bracket arms are as shown in FIG. 5. For the sake of simplicity, these two alternatives have been shown in the single bow illustrated in FIG. 1.

Figure 2:
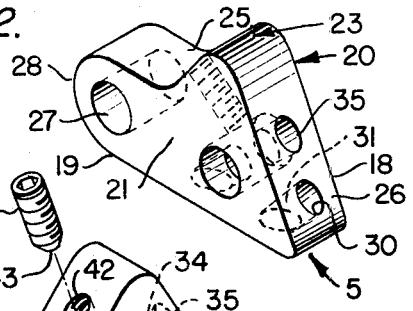
FIG. 2 is an enlarged bottom perspective view of the cable end attachment member.
Figure 3:
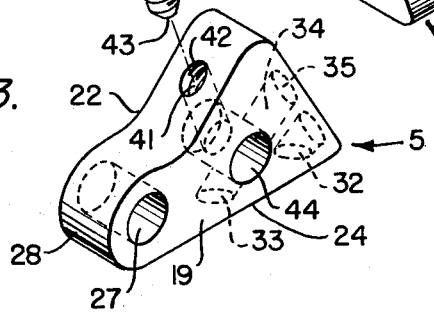
FIG. 3 is an enlarged top perspective view of the cable end attachment member.
Figure 4:
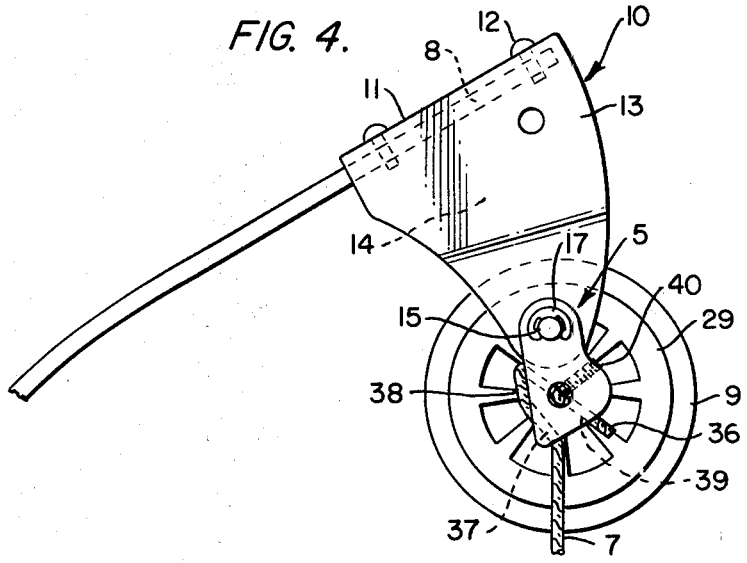
FIG. 4 is a partial side elevation of the cable end attachment member mounted outside an eccentric wheel bracket.

With the manner of mounting the attachment members 5 to the bow structure per se having been described, the details of the attachment member construction for receiving and securing either of the two cable ends 6 and 7 may now be explained, with particular reference being made to FIGS. 2, 3 and 4 of the drawings. In the enlarged base section 18, the base section bottom wall 26 is provided with a cable access opening 30 which leads to a first cable passageway 31 extending through the base section 18 to an exit opening 32 formed in the first transverse wall 24. Spaced above the exit opening 32 is an access opening 33 communicating with a second cable passageway 34 extending downwardly through the base section to an exit opening 35 formed in the bottom wall 26 adjacent the first passageway access opening 30. The relative angular disposition of the two cable passageways 31 and 34 will be most readily apparent from a review of FIG. 4 wherein it will be seen that these two passageways slightly converge from the bottom wall 26 or alternatively, diverge from the first transverse wall 24.

With an attachment member 5 appropriately mounted upon a pivot shaft 15, either cable end generally designated 6 or 7 may be secured to the bow by insertion within the attachment member as shown in FIG. 4. This is accomplished by guiding the distal portion 36 of the cable end 7, for example, initially through the access opening 30 until the distal portion 36 extends beyond the exit opening 32 a sufficient length to allow the subsequent insertion thereof into the access opening 33 and thence through the exit opening 35. When thusly disposed, a first end portion 37 of the cable end will be located within the first cable passageway 31 and a second cable end portion 38 will be seen to overlie the first transverse wall 24 between the two cable passageways. The remaining cable endmost section 39 will be disposed within the second cable passageway 34 and will form with the first cable end portion 37 a small divergent angle within the confines of the body base section 18. From an examination of the installed cable end shown in FIG. 4 of the drawings, it will be appreciated that at least a limited degree of anchorage of the cable end will be inherent in view of the sharp acute angle between the second cable end portion 38 and endmost section 39 yet quite obviously, a more positive fixation is necessary to insure reliability and safety in the connection.

The above positive fixation is provided by means of lock means, generally designated 40, and which may comprise an appropriate lock device such as threaded set-screw, adapted to be removably insertable through a lock receiving opening 41 communicating with the second transverse wall 25. Mating threads 42 in the opening 41 allow selective advancement and retraction of the lock device 40 to regulate the pressure of its nose 43 upon the periphery of the cable endmost section 39 disposed in the second cable passageway 34. The innermost portion of the lock receiving opening 41 not only communicates with the medial portion of the second cable passageway 34, but also with the periphery of an enlarged transverse anchor bore 44 extending through the body 20 between the two faces 21 and 22. The diameter of this transverse bore 44 is preferably greater than the diameter of the substantially perpendicular cable passageway 34 such that upon tightening of the lock device 40 its nose 43 radially displaces a medial portion of the cable endmost section 39 into the concavity formed by the larger periphery of the bore 44, thus substantially deflecting the axial extent of the cable section 39 to provide a positive crimping thereof and thorough fixation of the cable end 7 in the attachment member 5.

By the above provision of locking means insertable from the body edge 23 and extending parallel to the two faces 21-22 of the attachment member it will be appreciated that the transverse dimension of the body 20 need be very small as shown most clearly in FIGS. 5 and 6 of the drawings and this feature readily allows of mounting the constant thickness attachment member either inside or outside the wheel or pulley bracket and permits manipulation of the lock device without any interference.

From the foregoing, it will be seen that an improved manner of attaching archery bow cable ends has been presented which provides a positive anchoring of the cable by means of both a circuitous pathway as well as with releasable lock means. Not only is it possible to maintain proper relative tension of the two cable ends in a compound bow by manipulation of the lock means and shifting of the cable ends but also, flexibility is achieved by providing a cable attachment member useable at either end of a bow and either inside or outside of the eccentric pulley mounting brackets.

I claim:

1. An archery bow cable end attachment member including, a body having a base section provided with a cable passageway therethrough for longitudinally adjustably receiving a portion of said cable end therein, lock means selectively engageable with said cable end within said base section passageway, said body including two opposite faces joined by a peripheral edge, said edge having a plurality of intersecting walls, said cable passageway extending between two of said walls, said lock means including a threaded opening extending from another one of said walls to said cable passageway, a threaded lock device insertable with said opening, said body provided with a transverse anchor bore extending therethrough between said two opposite faces and disposed through said cable passageway, and said threaded opening communicating with said bore, a pivot section integral with said base section and having means adapted to receive a pivot pin for supporting said attachment member upon an archery bow.

2. An archery bow cable and attachment member according to claim 1 wherein, said bore diameter is greater than said cable passageway diameter whereby, tightening of said lock device radially deflects a portion of said cable end portion into the enlarged diameter of said bore.

3. An archery bow cable end attachment member according to claim 1 wherein, said body is provided with an additional cable passageway extending through two of said walls and receiving another portion of said cable end adjacent said portion within said first mentioned passageway whereby, a circuitous cable end pathway is defined by said attachment member.

4. An archery bow cable end attachment member according to claim 1 wherein, said base section includes a second cable passageway therethrough angularly disposed relative said other cable passageway for receiving another portion of said cable end whereby, an acute angle is defined between said two cable end portions.

5. An archery bow cable end attachment member according to claim 1 wherein, said body two opposite faces are planar and parallel and define a minimal body thickness therebetween with said cable passageway extending parallel to said two faces.

6. An archery bow cable end attachment member according to claim 1 wherein, said base section includes another cable passageway therethrough adapted to receive a portion of said cable end before insertion within said first mentioned cable passageway, said two cable passageways nonaxially aligned whereby said cable end portions disposed through said two passageways define a circuitous pathway.

7. A compound archery bow having wheels eccentrically mounted upon pivot pins disposed adjacent the bow limb tips, a cable passing around said wheels and having free ends attached adjacent said wheels, a cable end attachment member mounted upon at least one said pivot pin, said attachment member including a body having a base section provided with a cable passageway therethrough for longitudinally adjustably receiving a cable end therein, lock means selectively engageable with said cable end within said base section passageway, said body including two opposite faces joined by a peripheral edge, said edge having a plurality of intersecting walls, said lock means including a threaded opening extending from another one of said walls to said cable passageway, a threaded lock device insertable within said opening, said body provided with a transverse anchor bore extending therethrough between said two opposite faces and disposed through said cable passageway, said threaded opening communicating with said bore, and a pivot section integral with said section and having means adapted to receive said pivot pin.

8. A compound archery bow according to claim 7 wherein, said body provided with an additional cable passageway extending through two of said walls and receiving another portion of said cable end adjacent said portion within said first mentioned passageway whereby, a circuitous cable end pathway is defined by said attachment member.

9. A compound archery bow according to claim 7 wherein, said base section includes a second cable passageway therethrough angularly disposed relative said other cable passageway for receiving another portion of said cable end, whereby an acute angle is defined between said two cable end portions.

10. A compound archery bow according to claim 7 wherein, said body two opposite faces are planar and parallel and define a minimal body thickness therebetween with said cable passageway extending parallel to said two faces.

11. A compound archery bow according to claim 7 wherein, said base section includes another cable passageway therethrough adapted to receive a portion of said cable end before insertion within said first mentioned cable passageway, said two cable passageways non-axially aligned whereby said cable end portions disposed through said two passageways define a circuitous pathway.

* * * * *